US005328096A

United States Patent [19]

Stenge et al.

[11] Patent Number: 5,328,096

[45] Date of Patent: Jul. 12, 1994

[54] SPRAY APPARATUS AND METHOD OF OPERATION FOR SPRAYING HEAVY VISCOUS MATERIAL

[75] Inventors: Sylvan M. Stenge; Robert Mitchell, both of Sacramento County, Calif.

[73] Assignee: Xlent Equipment Co., Carmichael, Calif.

[21] Appl. No.: 60,748

[22] Filed: May 12, 1993

[51] Int. Cl.[5] ..... B08B 9/04; B05B 15/02

[52] U.S. Cl. ..... 239/123; 239/104; 239/321; 15/104.061

[58] Field of Search ..... 239/104, 106, 123, 1, 239/320, 321, 329; 222/148, 387, 389; 15/3.5, 3.51, 104.03, 104.05, 104.061

[56] References Cited

U.S. PATENT DOCUMENTS

| | | | |
|---|---|---|---|
| 1,075,898 | 10/1913 | Champ et al. | 222/389 X |
| 1,169,524 | 1/1916 | Baker | 222/387 |
| 1,207,752 | 12/1916 | Harrison | 222/389 |
| 1,325,348 | 12/1919 | Bowman | 15/104.061 |
| 1,430,840 | 10/1922 | Ostler | 239/321 X |
| 1,588,765 | 6/1926 | Mannion | 15/104.061 |
| 1,767,507 | 6/1930 | Buchet | 222/165 |
| 1,934,225 | 11/1933 | Candor | 222/387 |
| 2,443,146 | 6/1948 | Pyles | 239/320 X |
| 2,925,937 | 2/1960 | Schmidt et al. | 222/389 X |
| 3,179,375 | 4/1965 | Hamrick | 254/134.4 |
| 3,184,120 | 5/1965 | Undi | 222/209 |
| 3,186,597 | 6/1965 | Henderson | 222/30 |
| 3,451,091 | 6/1969 | Wallace | 15/104.061 |
| 3,790,038 | 2/1974 | Kifer | 222/386 |
| 3,957,176 | 5/1976 | Marston | 222/185 |
| 4,069,535 | 1/1978 | Cato | 15/104.061 |
| 4,550,466 | 11/1985 | Schmitz | 15/104.061 |
| 4,653,134 | 3/1987 | Ando | 15/3.51 |
| 5,221,047 | 6/1993 | Akeel | 239/123 |

FOREIGN PATENT DOCUMENTS

| | | | |
|---|---|---|---|
| 274383 | 8/1951 | Switzerland | 239/320 |
| 938840 | 7/1982 | U.S.S.R. | 239/104 |

*Primary Examiner*—Andres Kashnikow
*Assistant Examiner*—Lesley D. Morris
*Attorney, Agent, or Firm*—Flehr, Hohbach, Test, Albritton & Herbert

[57] ABSTRACT

A spray apparatus and method is disclosed for spraying heavy viscous material. The apparatus includes a pressure tank containing a supply of the material. Pressurized air is supplied to the upper end of the tank for forcing the material down through an outlet port at the tank's lower end and into a supply hose leading to a spray gun. A follower plate floating on the upper surface of the material carries a stopper cone which is aligned with the outlet port. As the material level nears the lower end of the tank, the follower plate moves the stopper cone against the outlet port to immediately and positively shut material flow off. A cleaning tool is provided and includes an air valve in combination with a sponge adapted for fitting into the hose. The sponge is pushed by air pressure through the hose for a first cleaning pass, and the air flow is controlled by a hand-operated air valve. The air valve is then disconnected and a water supply is then used to push the sponge through the hose for at least an additional cleaning pass.

3 Claims, 2 Drawing Sheets

SPRAY APPARATUS AND METHOD OF OPERATION FOR SPRAYING HEAVY VISCOUS MATERIAL

BACKGROUND OF THE INVENTION

1. Field of the Invention

This invention relates in general to apparatus and methods for spraying heavy viscous materials. In particular, the invention relates to the spraying of heavy viscous material such as aggregated materials which are difficult and expensive to handle and apply.

2. Description of the Prior Art

Heavy viscous materials such as aggregated materials have been applied by hand in the past. Attempts to apply the materials by spraying using hand held hopper guns or machines that employ rotor/stator pumps have met with limited success. The aggregated materials include gritty components which have a tendency to destroy many of the types of pumps that have been used to spray these materials. In the past, when the heavy aggregated material has been sprayed by this type of equipment, the machinery tends to break down, and is very costly to operate and maintain.

In the prior art, spray systems have been provided which include pressure pots or tanks through which a supply of material is forced out under air pressure. In the prior art spray systems problems arise when the material level nears the bottom of the pressure pot. At the point the pressurized air tends to push down through the material, through the tank's outlet port and out through the hose and spray gun. This causes objectionable spattering on the wall or other surface, and results in spoilage of the job.

Heavy viscous material is also difficult to clean out of the supply lines and hoses after the spraying operation. The conventional methods to clean the hoses include forcing the material out with water pressure. Cleaning elements such as sponges have also been used by forcing the sponges through the hose with water pressure. This method is not entirely satisfactory. Heavy viscous spray material is thick and tends to build up on the walls of the hose. Thus, the use of water pressure to force sponges through the hose is time consuming, and it takes as long as several minutes to push a sponge through a 50-foot hose. Normally the sponge must be pushed with the water pressure through the hose several times to thoroughly clean the material from the walls.

OBJECTS AND SUMMARY OF THE INVENTION

It is a general object of the present invention to provide a new and improved spray apparatus and method of operation for spraying heavy viscous material such as aggregated material.

Another object is to provide spray apparatus and methods of the type described which obviate the problem of material being spattered on the wall or other surface when the material level nears the bottom of the supply tank so that spoilage of the job is obviated.

Another object is to provide spray apparatus and method of operation of the type described which simplifies and speeds up the operation of cleaning residue material from inside the walls of hoses used in the spraying operation.

The invention in summary provides spray apparatus which includes a pressure tank having a reservoir chamber with an outlet port at its lower end. Pressurized air is supplied into the chamber and acts downwardly against the upper surface of the material, forcing the material through the outlet port and into a hose to a spray gun. A follower plate floating on the upper surface of the material follows the upper surface downwardly as a flow of material is supplied to the spray gun. The follower plate carries a stopper which is arranged to occlude the outlet port as the material level nears the bottom of the tank to positively shut off material flow. An air valve is provided for selectively coupling with the inlet end of the hose and to direct pressurized air into the inlet end for forcing a yieldable cleaning element through the hose to clean out material adhering to the wall of the hose.

The foregoing and additional objects and features of the invention will appear from the following specification in which the several embodiments have been set forth in detail in conjunction with the accompanying drawings.

BRIEF DESCRIPTION OF THE DRAWINGS

FIG. 2 is a fragmentary cross sectional view taken along the line 2—2 of FIG. 1 showing details of the pressure tank which is a component of the spray apparatus of.

DESCRIPTION OF THE PREFERRED EMBODIMENTS

Figure 1:
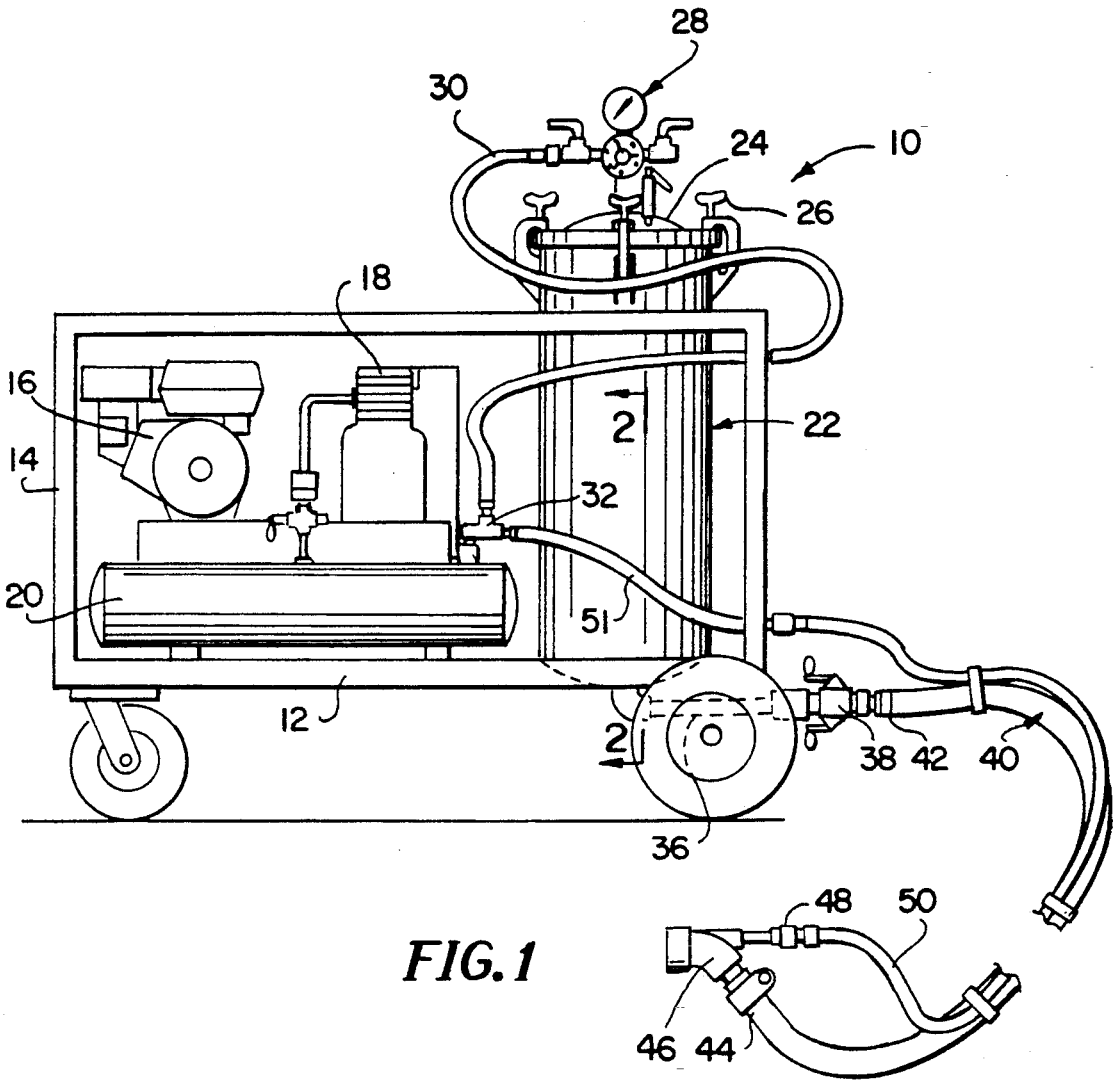
FIG. 1 is side elevational view of the spray apparatus according to a preferred embodiment of the invention.

In the drawings FIG. 1 illustrates generally at 10 spray apparatus of the invention for spraying heavy viscous material such as aggregated materials. Among the different types of materials with which the invention can be used are acrylics with aggregates, veneer plaster, driveway sealers, roof coatings, drywall textures and acoustics, waterproofing compounds, fireproofing, aggregated paints and finishes, base coats, color primers, and elastomeric and latex finishes.

Spray apparatus 10 is comprised of a mobile steel chassis 12 carrying a cabinet 14 in which an air compressor engine 16, compressor pump 18 and air tank 20 are mounted. An upright pressure pot or cylindrical tank 22 is mounted in one end of the cabinet. A lid 24 is releasably mounted at the upper end of the tank, and the lid can be opened by fasteners 26 for inserting a supply of the material. A pressure gauge and valve assembly 28 is mounted on top of the lid, and an air line 30 connects assembly 28 with air distributor fitting 32 on air tank 20. An outlet port 34 is provided in the lower end of tank, and the port is connected through nipple 35 and pipe 36 with a quick-release can lock connector 38.

A material supply hose 40, having a large diameter on the order of one inch, is provided and includes an inlet end 42 which is adapted for connection with cam lock connector 38. The hose includes an outlet end 44 that is adapted for connection with a flexible spray gun 46, which is preferably of the drywall spray gun type. Spray gun 46 includes an air inlet fitting 48 which is connected with air line 50 which in turn is releasably coupled into air line 51 leading to air distributor fitting 32 on the air tank.

Figure 2:
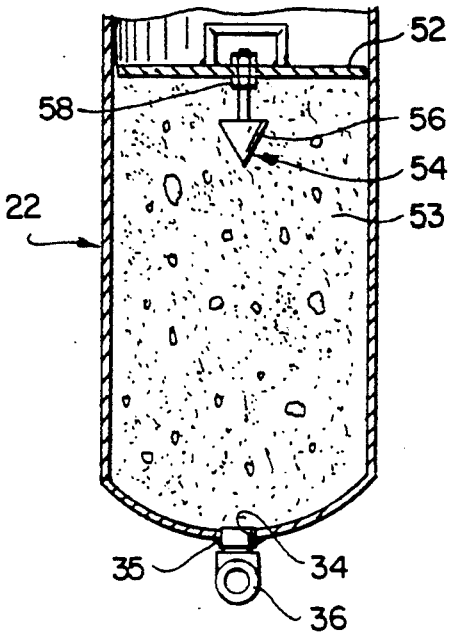
Figure 3:
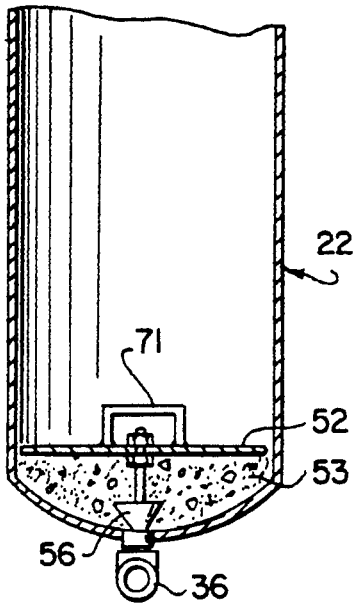
FIG. 3 is a cross sectional view similar to FIG. 2 showing elements within the pressure tank at their position when the material level is near the bottom of the tank.

As best shown in FIGS. 2 and 3, a follower plate 52 is provided within the pressure tank, and the outer perimeter of the plate is sized and shaped commensurate with the inner cylindrical wall of the tank. Typically, the inner diameter of the tank is 14 inches, and in that case the outer diameter of the follower plate would preferably be 13.5 inches. The follower plate has a weight on the order of 6 pounds, which is sufficient to float the plate on the upper surface of the supply of material 53.

A stopper element 54 is provided and comprises a stopper cone 56 mounted by means of a bolt 58 below the follower plate. The cone is vertically aligned with the centerline of outlet port 34. Stopper cone 56 is formed with a conical outer surface having its apex directed downwardly. The cone is comprised of a suitable hard but flexible elastomeric material, such as rubber material, which forms a good seal when pressed downwardly into the outlet port. Typically the inner diameter of the outlet port is one inch, and in this case the stopper cone would preferably have an outer diameter at its upper base of two inches. In the position shown in FIG. 3 where the material level has dropped sufficient so that the follower plate moves stopper cone 56 down to fully occlude the outlet port, the lower surface of the follower plate is only substantially two inches to two and one-half inches from the tank bottom. When the follower plate moves to this position, the stopper cone is effective to immediately and positively shut off material flow.

Figure 4:
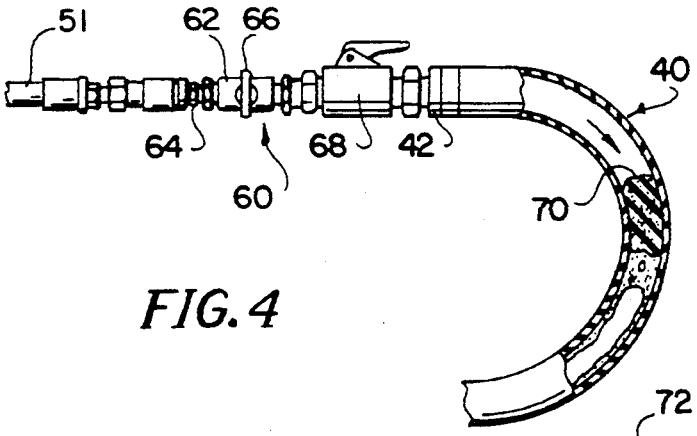
FIG. 4 is a side view, partially broken away, of the cleaning tool of the invention shown attached to the inlet end of a supply hose and showing one stop in the cleaning method of the invention.
Figure 5:
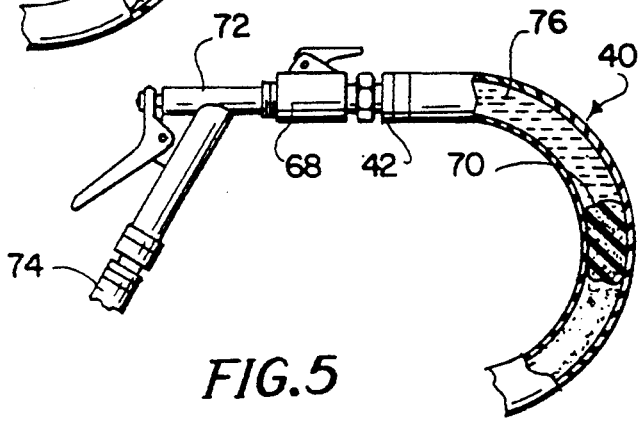
FIG. 5 is a view similar to FIG. 4 showing another step in the cleaning operation.

FIGS. 4 and 5 illustrate the cleaning tool 60 of the invention for cleaning material from within the hose after the spraying operation has been completed. Cleaning tool 60 is comprised of a hand-operated air valve 62 having at one end a fitting 64 which is adapted for connection with air line 51. A handle 66 is provided for opening and closing air flow through the fitting 64. The opposite end of the fitting is connected with one end of a quick disconnect hose coupling 68. The opposite end of the hose coupling is selectively connected with inlet end 42 of material supply hose 40. Cleaning element 70 is provided and comprises a sponge having a cross section sufficient to span the cross section of the hose inner wall. An outer diameter of one and one-quarter inches for the sponge is appropriate for this purpose where the inner diameter of hose 40 is one inch. The sponge is compressed when pushed into the hose inlet to provide a good sliding air seal and to also wipe the hose inner wall. Preferably the sponge is made of a dense type cellulose material.

The use and method of operation of the invention is as follows. With the components connected as shown in FIG. 1, and with pressure tank 22 filled with the heavy viscous material 53 as shown in FIG. 2, the spraying operation is initiated by turning the air valve assembly 28 on. This directs pressurized air into the upper end of the tank. An air pressure in the range of 15–20 psi is suitable for most applications. As spray gun 46 is operated, material is pushed down by the air pressure through outlet port 34 and hose 40 into the gun. Air delivered through line 50 pushes the material out of the gun's spray tip and dispenses it in the desired pattern.

As the material level drops in the tank, follower plate 52 floats down with the upper surface of the material, carrying stopper cone 56 down with it. As the material level nears the bottom of the tank to the point shown in FIG. 3, the stopper cone is moved by the follower plate so that it is inserted downwardly into the outlet port. This occludes the outlet port and provides an immediate and positive shut off of material flow. This in turn prevents any mixture of air and material from being pushed through the outlet port and obviates the problem of spattering on the wall or other surface. When the tank is substantially empty, the follower plate can be pulled up and out of the tank by means of handle 71 for refilling the tank, as desired.

At the conclusion of the spray operation, hose 40 is disconnected from cam lock connector 38. Sponge 70 is then inserted into the hose inlet end 42, which is then connected with hose coupling 68 of cleaning tool 60. Fitting 64 is then connected with air line 51, which is then pressurized from air tank 20 to the 15–20 psi level. Handle 66 is then manually operated to turn air valve 62 on, thereby directing the pressurized air into the inlet end of the hose and moving the sponge along the hose towards outlet end 44. The material which sticks to the inner wall of the hose is substantially pushed out by the sponge, which emerges from the hose's outlet end. Air valve 62 is then disconnected from hose coupling 68. A water nozzle 72 connected with a hose 74 leading to a suitable water supply, such as a municipal water supply, is then provided. Hose coupling 68 is first disconnected from inlet end 42 of the hose and sponge 70 is reinserted. Coupling 68 is then reconnected to the hose, and the outlet end of nozzle 72 is inserted into the open end of the coupling. The nozzle is then turned on to force water, shown at 76 in FIG. 5, into the inlet end of the hose. This water propels the sponge through the hose for a second pass which more thoroughly cleans the inner wall. This operation could be repeated by forcing the sponge with water through the hose for a third pass, as required.

In the invention the cleaning steps are more effective in cleaning the thick and sticky aggregate material from the inner wall of the hose. With the invention approximately 95% of the aggregate material can be cleaned out of the hose on the first pass using the air pressure to move the sponge. The air pressure exerts a substantial force which easily moves the heavy, sticky material. Substantially all of the remaining material can be cleaned out on the second pass by pushing the sponge through with water pressure. The cleaning operation is much quicker than conventional methods. For example, it takes only a few seconds to push the sponge with air pressure through a 50-foot hose for the first pass.

While the foregoing embodiments are at present considered to be preferred it is understood that numerous variations and modifications may be made therein by those skilled in the art and it is intended to cover in the appended claims all such variations and modifications as fall within the true spirit and scope of the invention.

What is claimed is:

1. Spray apparatus for spraying heavy viscous material comprising the combination of a pressure tank having a reservoir chamber for containing a supply of said material which has an upper surface, said chamber having a lower end which includes an outlet port, means for supplying pressurized air within the chamber for acting downwardly against said upper surface of the supply of material and for forcing the material out of the chamber through the outlet port with said upper surface of the supply of material moving downwardly as material is forced out of the outlet port, follower plate means within the chamber, the follower plate means having a lower end for floating over said upper surface of the supply of material, said follower plate means moving within the chamber from an upper position to a lower position responsive to downward movement of the upper surface of the supply of material, stopper means carried by said follower plate means for moving into occluding relationship with said outlet port responsive to movement of the follower plate to said lower position for shutting off material flow through said outlet port, a hose having an inlet end, an outlet end and inner cylindrical wall, means for selectively coupling said inlet end of the hose with said outlet port of the reservoir chamber for directing material being forced out of the outlet port through the cylindrical wall of the hose toward said outlet end, an air valve adapted for connection with source of pressurized air, means for selectively coupling said air valve with said inlet end of the hose, and a yielding cleaning element having a cross sectional size which spans across said inner cylindrical wall of the hose with the cleaning element being insertable into said inner end of the hose and being forced through the hose responsive to air pressure directed into the inlet end from the air valve and said source of pressurized air whereby the cleaning element moves through said inner cylindrical wall toward said outlet end and pushes residue material out of the hose.

2. Apparatus as in claim 1 in which said cleaning element comprises a sponge.

3. Spray apparatus for spraying heavy viscous material comprising the combination of a pressure tank having a reservoir chamber for containing a supply of said material, said chamber having an outlet port for directing material out of the chamber, means for selectively coupling said outlet port with an air hose having an inlet end, outlet end and inner cylindrical wall through which material is directed to a spray gun, an air valve including means for selectively coupling said inlet end of the hose with a source of pressurized air, and a yieldable cleaning element adapted for insertion into said inner cylindrical wall of the hose, said cleaning element having a cross sectional size which spans across said inner cylindrical wall for cleaning material from said wall responsive to the movement of the cleaning element towards said inlet end under influence of pressurized air being directed into said inlet end.

* * * * *